US012599213B2

(12) United States Patent
Crowley et al.

(10) Patent No.: US 12,599,213 B2
(45) Date of Patent: Apr. 14, 2026

(54) HAIR TOOL

(71) Applicant: Procare UK Limited, Bristol (GB)

(72) Inventors: Jonathan Crowley, Bristol (GB); Myles Bates, Weston-super-Mare (GB)

(73) Assignee: Procare UK Limited, Bristol (UA)

( * ) Notice: Subject to any disclaimer, the term of this patent is extended or adjusted under 35 U.S.C. 154(b) by 346 days.

(21) Appl. No.: 18/192,055

(22) Filed: Mar. 29, 2023

(65) Prior Publication Data

US 2024/0324747 A1 Oct. 3, 2024

(30) Foreign Application Priority Data

Apr. 7, 2022 (GB) ..... 2205146

(51) Int. Cl.
*A45D 19/00* (2006.01)

(52) U.S. Cl.
CPC ..... *A45D 19/016* (2021.01)

(58) Field of Classification Search
CPC .. A45D 19/012; A45D 19/016; A45D 19/018; A45D 24/02; A45D 24/10
USPC ..... 221/1; 294/1.1, 64.1
See application file for complete search history.

(56) References Cited

U.S. PATENT DOCUMENTS 3,225,912 A * 12/1965 Bryant ..... A01K 97/16 206/362
4,993,949 A * 2/1991 Hill ..... A61C 3/00 433/141
5,256,064 A * 10/1993 Riihimaki ..... A61C 3/00 433/141
5,287,864 A * 2/1994 Gallo ..... A45D 19/018 132/270
6,189,540 B1 * 2/2001 Stovall ..... A45D 24/10 132/219
6,220,250 B1 * 4/2001 Park ..... A45D 31/00 132/73
8,240,731 B2 * 8/2012 Roszak ..... E01H 1/12 294/212

(Continued)

FOREIGN PATENT DOCUMENTS

KR 1020110094789 A 8/2011
KR 1020190102316 A 9/2019

OTHER PUBLICATIONS

European Search Report from EU Application No. 23164403 mailed Oct. 4, 2023.

(Continued)

*Primary Examiner* — Rachel R Steitz
*Assistant Examiner* — Karim Asqiriba
(74) *Attorney, Agent, or Firm* — Vorys, Sater, Seymour and Pease LLP

(57) ABSTRACT

There is described a hair tool comprising a handle and a spine extending from the handle to a top, and two opposing ends which extend from the spine respectively at a top and proximal to the handle, to form a structural base with the spine, wherein the comb further comprises a plurality of teeth extending from one side of the spine between the two opposing ends, and wherein the structural base comprises a chamfered outer edge between the spine and the end at the top of the spine, and wherein an adhesive pad is disposed on the chamfered edge, the adhesive pad comprising an exposed foil side with an adhesive for adhering to and picking up strips of aluminium foil.

11 Claims, 2 Drawing Sheets

(56) References Cited

U.S. PATENT DOCUMENTS

| | | | | |
|---|---|---|---|---|
| 2004/0118424 | A1* | 6/2004 | Russell | A61Q 5/10<br>132/270 |
| 2012/0060633 | A1 | 3/2012 | Ishida et al. | |
| 2012/0217258 | A1* | 8/2012 | DeSopo | A45D 19/018<br>221/1 |

OTHER PUBLICATIONS

UK Search Report for Application No. GB2205146.0 mailed Sep. 28, 2022.

* cited by examiner

HAIR TOOL

BACKGROUND

The present invention relates to a hair tool.

Hairdressers typically use hair tools such as combs and brushes when colouring hair to separate strands of hair for colouring, and are required to pick up strips of aluminium foil for placing in the hair, often with gloves on which makes this a difficult task.

SUMMARY OF THE DISCLOSURE

According to an aspect, there is provided a hair tool comprising: a handle and a spine extending from the handle to a top, and two opposing ends which extend from the spine respectively at the top and proximal to the handle, to form a structural base with the spine, and wherein the structural base comprises a chamfered outer edge between the spine and the end at the top of the spine, and wherein an adhesive pad is disposed on the chamfered edge, the adhesive pad comprising an exposed foil side with an adhesive for adhering to and picking up strips of aluminium foil.

The two opposing ends may be substantially parallel. The two opposing ends may extend from the spine substantially within a plane.

A fixing side of the adhesive pad may be adhered to the end of the structural base with an adhesive.

The adhesiveness in N/mm2 of the adhesive on the fixing side may be higher than the adhesiveness in N/mm2 of the adhesive on the foil side.

The adhesive pad may be removable from the end and replaceable. The chamfered edge may comprise a recess to retain the adhesive pad and prevent movement of the adhesive pad on the chamfered edge.

The adhesive pad may have a depth which is larger than a depth of the recess such that the adhesive pad protrudes from the recess.

The adhesive pad may comprise a foam structure which is configured to resiliently compress on application of force.

The adhesive on the foil side of the adhesive pad may be able to hold between 0.02N and 0.05N.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described, by way of example only, with reference to the accompanying Figures, in which.

DETAILED DESCRIPTION

Figure 1:
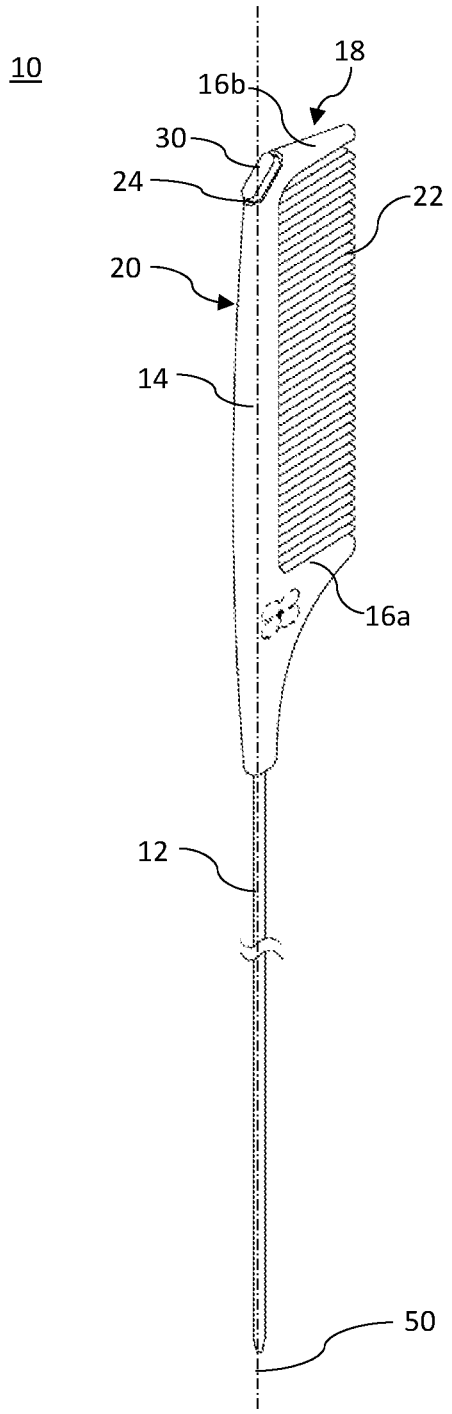
FIG. 1 schematically shows a perspective view of an example comb.

FIG. 1 shows an example comb 10. The comb 10 comprises a handle 12, which in this example is an extended pin, otherwise known as a comb tail. The handle 12 is elongate and extends along an elongate axis 50. In other examples, it may be any form of handle for holding the comb.

The comb 10 further comprises a structural base 20 comprising a spine 14, and two opposing ends 16. The spine 14 extends from the handle 12 to a top 18. A first end **16*a* extends from the spine 14 at a location proximal to the handle 12, and a second end 16*b* extends from the spine 14 at the top 18. An inner surface of the ends 16 and an inner surface of the spine 14 forms a U-shaped profile. Within the U-shaped profile a plurality of teeth 22 extend from the spine between the two opposing ends 16. The teeth 22 and the ends 16 extend from one side of the spine 14 in substantially the same plane. In this example, the teeth 22 and the ends 16 extend in parallel directions from the spine 14**.

In this example, the structural base comprises a chamfered edge 24 on an outer surface, where the second end **16*b* at the top 18 meets the spine 14. An adhesive pad 30 is disposed on the chamfered edge 24 on the outer surface. The adhesive pad 30 comprises an exposed foil side with an adhesive for picking up strips of aluminium foil for hairdressers. The comb 10**, which is often being held by a hairdresser, for example, during hair colouring, can then be easily used by hairdressers to pick up and place strips of aluminium foil in a client's hair.

The adhesive pad 30 in this example comprises a PVA based adhesive on the foil side, which is configured to enable adhesion of a strip of aluminium foil to the adhesive pad 30. A PVA based adhesive remains adhesive for a long time and can be washed with water to rejuvenate the adhesiveness. In other examples, any suitable adhesive may be used.

The applicant has found that forming a chamfered edge 24 on the corner of the comb 10 makes the comb 10 more ergonomic for a user, since it is more intuitive and easier for a user to place a corner of the comb on an aluminium strip for adhesion of the aluminium strip, than to place the whole spine 14 or the whole end 16 flat on a strip of aluminium foil.

In this example, the adhesive pad 30 is fixed to the second end **16*b* on a fixing side of the adhesive pad 30 with adhesive. In this example, the adhesive with which the adhesive pad 30 is fixed to the second end 16*b* is semi-permanent. This allows the adhesive pad 30 to be removed from the second end 16*b*, and replaced with a new adhesive pad 30, when the adhesive on the foil side no longer has sufficient adhesiveness. The strength of adhesion of the adhesive pad 30 to the structural base 20 is larger than the strength of adhesion of a strip of foil to the adhesive pad 30, so that the strip of foil can be picked up with the comb 10 and removed from the comb 10 without pulling the adhesive pad 30 off the structural base 20**.

In this example, the adhesiveness of the adhesive on the fixing side (in N/mm2) is higher than the adhesiveness of the adhesive on the foil side (in N/mm2) such that the foil side and the fixing side can have the same surface area, while the strength of adhesion on the fixing side is higher than the foil side. This simplifies the design of the adhesive pad 30.

In this example, the adhesiveness of the foil side adhesive is approximately 12 g/cm2 (0.0012 N/mm2), and the surface area of the foil side and adhesive on the foil side is approximately 25 mm2, such that the foil side adhesive can support up to 3 g (or 0.03N). In other examples, the adhesiveness and surface area of the adhesive on the foil side may be any suitable values, such as being able to hold between 0.02N-0.05N, to enable the foil side to pick up a strip of aluminium foil for hair colouring, whilst allowing the strip of foil to be pulled from the comb 10 without ripping the foil.

Figure 2:
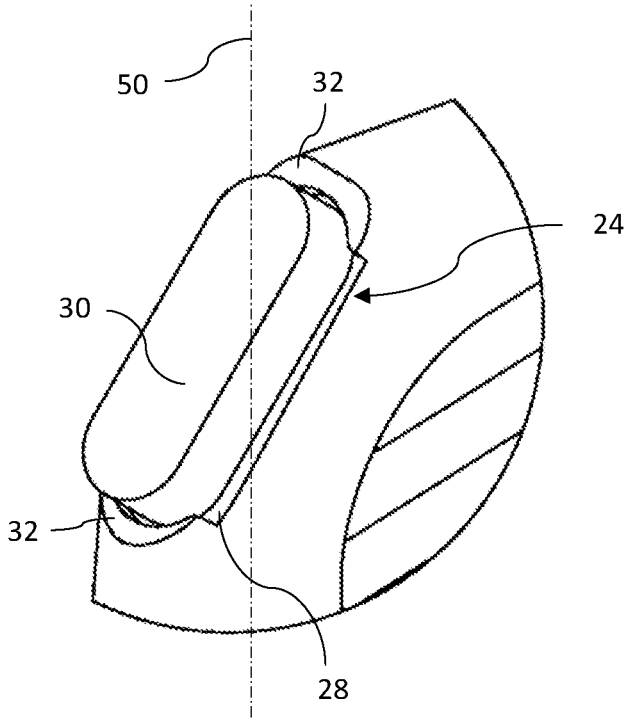
FIG. 2 schematically shows a close-up view of a portion of the example comb.

FIG. 2 shows a close-up view of the chamfered edge 24 of the structural base 20. In this example, the chamfered edge 24 comprises a recess 28 which is shaped to receive and retain the adhesive pad 30. The adhesive pad 30 is received within the recess 28. The recess 28 is defined by protruding ledges 32 which are configured to prevent movement of the adhesive pad 30 on the chamfered edge 24.

In this example, the adhesive pad is disposed at an angle with the elongate axis 50 of approximately 45 degrees. In other examples, the angle may be anywhere between 20-70 degrees. Providing the adhesive at such an angle further improves the ergonomics of the comb 10 for the user, since it is easier to press the adhesive pad 30 onto a surface when holding the handle 12.

In other examples, there may be no recess in the chamfered edge. In this example, the depth of the recess 28 is smaller than the depth of the adhesive pad 30 such that the adhesive pad 30 protrudes from the recess 28. This improves access to the foil side of the adhesive pad 30.

In this example, the adhesive pad 30 comprises a foam structure which is configured to resiliently deform on application of force. Therefore, when pressing the comb 10 on a strip of aluminium foil via the adhesive pad 30, the adhesive pad 30 is able to compress until it meets the ledges 32. The compressibility provides a more ergonomic feel, whilst ensuring that more of the foil side of the adhesive pad 30 is able to contact, and adhere to, the foil.

Similarly, the foam structure allows the adhesive pad 30 to stretch and flex when the foil is being removed from the adhesive pad 30, which helps to prevent the adhesive pad 30 from dislodging from the structural base 20.

Although the foregoing description has described a comb, it will be appreciated that the invention may be applied to any hair tool, such as a brush. Any such hair tool may comprise a structural base and an exposed surface on which an adhesive pad is placed.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

What is claimed is:

1. A hair tool comprising:

a handle and a spine extending from the handle to a top, and two opposing ends which extend from the spine respectively at the top and proximal to the handle, to form a structural base with the spine, wherein the structural base comprises a chamfered outer edge between the spine and the end at the top of the spine, wherein the handle and/or the spine extend along an elongate axis and the chamfered edge is at an oblique angle to the elongate axis, and wherein an adhesive pad is disposed on the chamfered edge, the adhesive pad comprising an exposed foil side with an adhesive for adhering to and picking up strips of aluminium foil.

2. The hair tool according to claim 1, wherein a fixing side of the adhesive pad is adhered to the end of the structural base with an adhesive.

3. The hair tool according to claim 2, wherein the adhesiveness in N/mm2 of the adhesive on the fixing side is higher than the adhesiveness in N/mm2 of the adhesive on the foil side.

4. The hair tool according to claim 1, wherein the adhesive pad is removable from the end and replaceable.

5. The hair tool according to claim 1, wherein the chamfered edge comprises a recess to retain the adhesive pad and prevent movement of the adhesive pad on the chamfered edge.

6. The hair tool according to claim 5, wherein the adhesive pad has a depth which is larger than a depth of the recess such that the adhesive pad protrudes from the recess.

7. The hair tool according to claim 1, wherein the adhesive pad comprises a foam structure which is configured to resiliently compress on application of force.

8. The hair tool according to claim 1, wherein the adhesive on the foil side of the adhesive pad can hold between 0.02N and 0.05N.

9. A hair tool according to claim 1, wherein the oblique angle is between 20 and 70 degrees.

10. A hair tool according to claim 1, wherein the chamfered edge has a flat surface for supporting the pad.

11. A hair tool according to claim 1, wherein the exposed foil side is substantially flat.

* * * * *